US005463822A

United States Patent [19]

Miller

[11] Patent Number: 5,463,822

[45] Date of Patent: Nov. 7, 1995

[54] SHOE WITH A CENTRAL ROTARY CLOSURE AND SELF-ALIGNING COUPLING ELEMENTS

[75] Inventor: Dave Miller, Carver, Mass.

[73] Assignee: Puma AG, Herzogenaurach, Germany

[21] Appl. No.: 249,356

[22] Filed: May 27, 1994

[30] Foreign Application Priority Data

May 28, 1993 [DE] Germany ..... 93 07 480.8

[51] Int. Cl.[6] ..... A43B 11/00

[52] U.S. Cl. ..... 36/50.1; 36/54

[58] Field of Search ..... 36/50.1, 50.5, 36/54, 117, 88, 89; 24/685 K, 68 B, 713.5

[56] References Cited

U.S. PATENT DOCUMENTS

| | | | |
|---|---|---|---|
| 5,117,567 | 6/1992 | Berger . | |
| 5,177,882 | 1/1992 | Berger . | |
| 5,181,331 | 1/1993 | Berger . | |
| 5,319,868 | 6/1994 | Hallenbeck | 36/50.1 |
| 5,325,613 | 7/1994 | Sussman | 36/50.1 |
| 5,408,761 | 4/1995 | Gazzano | 36/88 |

FOREIGN PATENT DOCUMENTS 9108686 6/1991 WIPO .

*Primary Examiner*—Paul T. Sewell
*Assistant Examiner*—Thomas P. Hilliard
*Attorney, Agent, or Firm*—Sixbey, Friedman, Leedom & Ferguson; David S. Safran

[57] ABSTRACT

A shoe with an upper made of resiliently flexible materials, a central rotary closure, an instep cover in an instep area of the upper, at least one tightening element connected to the central rotary closure, and guide elements at side parts of the upper. The at least one tightening element is guided from the instep cover laterally in the form of loops which are guided over a deflecting element of a respective one of the guide elements. The central rotary closure enables the tightening element to be shortened by rotating the central rotary closure to close the shoe and increasing of the free length of the tightening element to open the shoe. A first end portion of the pull strap is fastened to the shoe in an area at which a portion of a wearer's foot near the metatarsophalangeal joints is received and from there the pull strap is guided over a front one of the coupling elements to a deflecting element located in an area of the metatarsus, and from there, is guided over a more rearward coupling element rearwardly to an area at which the heel of the wearer's foot is received and at which a second end portion of the pull strap is fastened. Furthermore, each of the coupling elements is free to move relative to the shoe upper since they are carried only by a respective one of the loops of the at least one tightening element and by the pull strap.

14 Claims, 3 Drawing Sheets

SHOE WITH A CENTRAL ROTARY CLOSURE AND SELF-ALIGNING COUPLING ELEMENTS

BACKGROUND OF THE INVENTION

1. Field of the Invention

This invention relates to a shoe, especially an athletic shoe, with a central rotary closure which is provided on an instep cover, and a tightening element that can be drawn in and let out by the central rotary closure and is guided from the instep cover laterally and is looped over deflecting elements of guide elements that are located in the area of the side parts of the upper.

2. Description of Related Art

Shoes of the type to which the present invention is directed are known, for example, from U.S. Pat. Nos. 5,117,567 and 5,181,331. In the shoes described therein, the central rotary closure is attached to an instep cover, to which lateral closing flaps, for side parts of the upper, are molded-on in a hinged manner. The tightening element that can be tightened with the central rotary closure runs from the instep cover alternately over guide elements of the closing flaps and the instep cover.

Further, it is known from one embodiment of the previously mentioned patents and from U.S. Pat. No. 5,177,882 to make the closing flaps as separate parts from the instep cover. In this case, the guide elements are attached to lateral straps which run over the shoe upper to the area of the shoe sole and which connect to the closing flaps via corresponding recesses formed in the closing flaps.

SUMMARY OF THE INVENTION

The primary object of this invention is to simplify and thus to configure more economically the closing device for a shoe of the aforementioned type.

This object is achieved by a preferred embodiment of the invention of a shoe with a central rotary closure in which similar coupling elements of a simple design can be used, and insertion of the tightening element or several tightening elements and pull straps can be performed in a simple way.

More specifically in the shoe according to the present invention, each guide element is provided on a freely movable coupling element which has a deflecting bar. A pull strap is fastened to the shoe, either the upper or sole, in the area of the metatarsophalangeal joints or in an area between the metatarsophalangeal joints and the metatarsus, this pull strap being guided over the deflecting bar of a front coupling element to a guide element in an area of the metatarsus and is guided from there over a deflecting bar of another or of a rear coupling element, and after deflection over it, is guided rearwardly to a fastening point in the heel area of the shoe where it is fixed. The coupling elements are positionally connected to the shoe upper only by connections to loops of the tightening element and to the pull strap.

These and further objects, features and advantages of the present invention will become apparent from the following description when taken in connection with the accompanying drawings which, for purposes of illustration only, show a single embodiment in accordance with the present invention.

DETAILED DESCRIPTION OF THE PREFERRED EMBODIMENT

Figure 1:
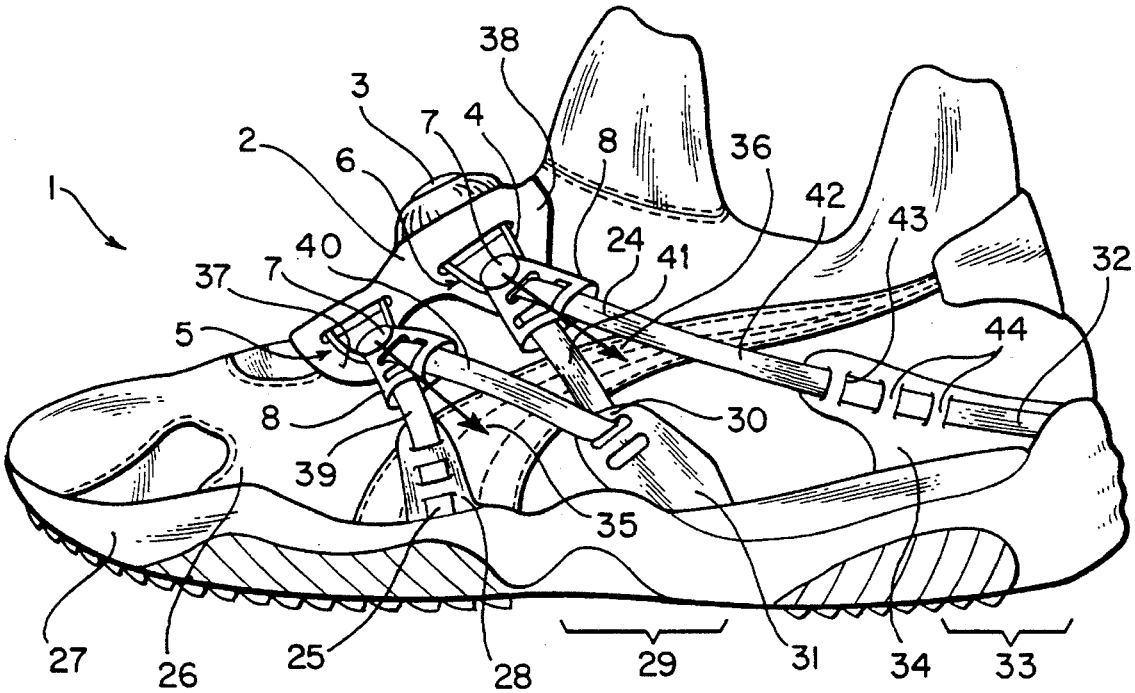
FIG. 1 is a side elevational view of the lateral side of a shoe according to the invention.

A shoe, especially a sport or leisure shoe 1 has an upper 26 formed of elastically flexible materials, such as fabrics, leather, etc. Shoe 1 has a central rotary closure 3 attached to an instep cover 2. The rotary closure is of the type used in the initially-mentioned patents, for example, and can be attached to the upper in the manner disclosed in co-pending U.S. patent application Ser. No. 08/113,659. Additionally, as is the case for such known central rotary closures, it can be locked during tightening and when closed, yet is able to be quickly released for opening.

A tightening element 4 is coupled with central rotary closure 3. This element can consist of a metal or plastic wire or of a metal or plastic rope or the like. Several tightening elements 4 can also be provided.

Tightening element 4 or several such tightening elements is or are guided in instep cover 2 so that, on each side of instep cover 2, at least two loops 5 and 6 are formed which exit the instep cover at a distance from one another.

Figure 2:
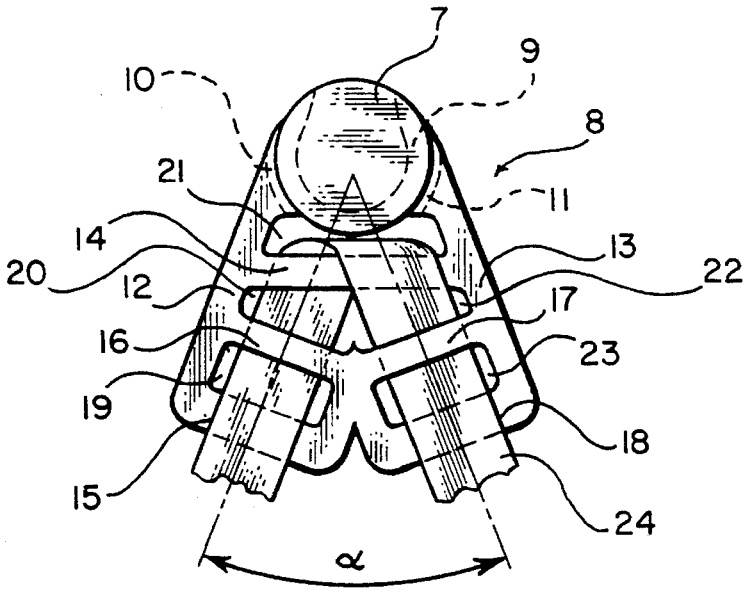
FIG. 2 is a front view of a coupling element with a portion of a strap passing therethrough.
Figure 3:
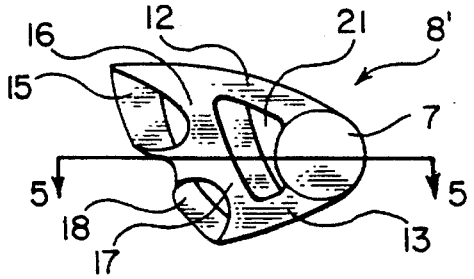
FIGS. 3 & 4 are front and rear views of a second form for the coupling element.
Figure 4:
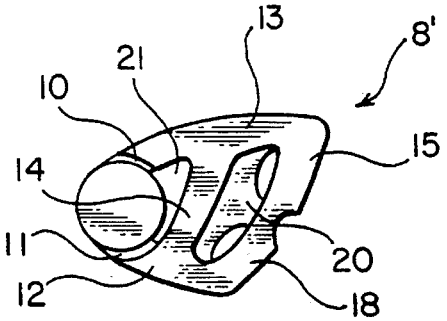
Figure 5:
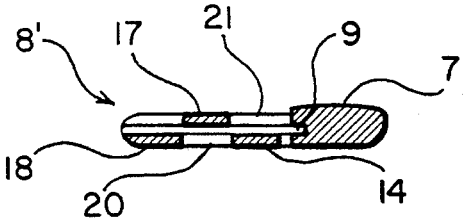
FIG. 5 is a sectional view taken along line 5—5 of FIG. 3.
Figure 7:
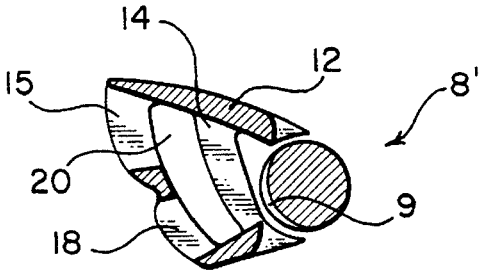
FIG. 7 is a sectional view taken along line 7—7 of FIG. 6.
Figure 6:
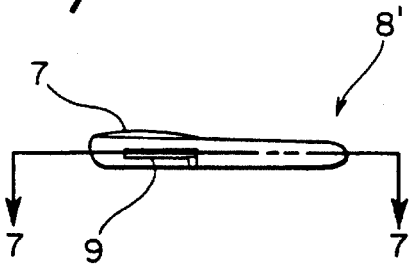
FIG. 6 is a side view of the coupling element of FIGS. 3–5.

Each of the Loops 5, 6 is wound around a respective guide element 7 in the form of, for example, a knob-shaped, mushroom-shaped or similar shaped portion of a freely movable coupling element 8. Loops 5 or 6 lies in a guiding groove 9 of the guide element 7, into which it can be inserted from the back side. For this purpose, the back side of coupling elements 8 in the area of deflecting element 7 is provided with corresponding recesses 10 and 11 (see FIGS. 2, 5 & 7).

Coupling elements 8 have two guide arms 12, 13, which enclose an acute angle $\alpha$ of about 25° to 50°, especially of about 30° to 40°. A deflecting bar 14 is provided extending between the guide arms 12, 13 in the vicinity of guide element 7. Furthermore, the guide arms 12, 13 have slot openings 19 to 23 forming two preferably rod-shaped or bar-shaped holding means 15, 16 or 17, 18 in each arm, as well as a deflecting bar 14 of the coupling element 8.

In FIGS. 3–7, a modified configuration for the coupling element 8 is shown in greater detail. This modified coupling element is designated 8' but so that the correspondence of both forms of the coupling element can be discerned and to eliminate the need for a redundant description of its parts, the same reference numerals have been used in FIGS. 3–7 as have been used in FIG. 2. The coupling element 8' differs from the coupling element 8 only in the ornamental appearance thereof and in the fact that the bar-shaped holding means 16 and 17 are no longer in the same plane as the deflecting bar 14 and the holding means 15, 18. The use, function and operation coupling elements 8, 8' are identical, and are made of a hard elastic plastic, which has a low coefficient of friction for the tightening element 4.

A pull strap 24 is looped through each coupling element 8, 8' so that it is respectively deflected from guide arm 12 to guide arm 13 of same coupling element 8, 8'.

A front end section 25 of pull strap 24 is fastened to the upper 26 or sole 27 of the shoe 1 or to a support part attached thereto, for example, the shoe vamp, or a strap-type support part 28. Support part 28 is located in the area of shoe 1 between the metatarsus, or the middle of the shoe, and the metatarsophalangeal joints. From there, pull strap 24 is guided to the front coupling element 8, 8' where it passes around its deflecting bar 14 to the rear and downward to a holding strap 31 which is attached an area 29 of the metatarsus on the lateral side of the shoe or to the area of the arch of the foot on the medial side of the shoe. The pull strap 24 passes over a rod-shaped deflecting means 30 of the holding strap 31.

Figure 12:
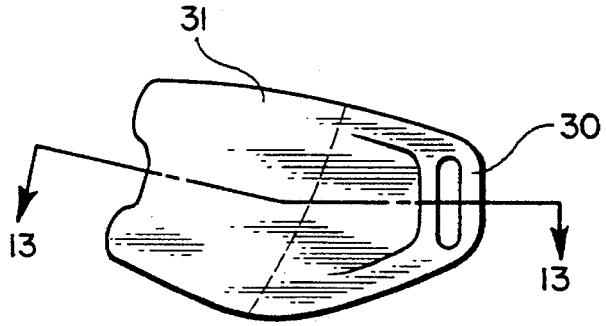
FIG. 12 is a front view of a medial side support part.
Figure 13:
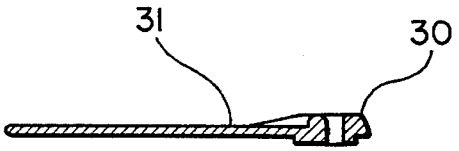
FIG. 13 is a cross-sectional view taken along line 13—13 of FIG. 12.
Figure 14:
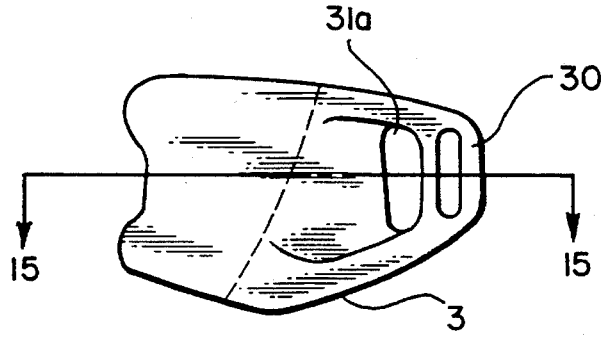
FIG. 14 is a front view of a frontal area support part.
Figure 15:
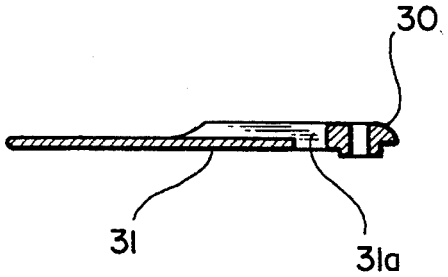
FIG. 15 is a cross-sectional view taken along line 15—15 of FIG. 14.

As seen from a comparison of FIGS. 12 & 13 with FIGS. 14 & 15, the lateral side holding strap 31 of the medial side (FIGS. 12 & 13) is shorter than that of the lateral side (FIGS. 14 & 15) so as to comfortably fit in the arch area, and an additional opening 3 1 a is provided in the lateral side holding strap 31 to allow it to conform more easily to the contour of the shoe. Holding strap 31 is inclined slightly forward (as can be seen in FIG. 1 and is represented in FIGS. 12 & 14 by a dashed line approximation of the sole line), and from holding strap 31, the pull strap 24 is guided upward to the deflecting bar 14 of the next or rear coupling element 8, 8'.

Figure 8:
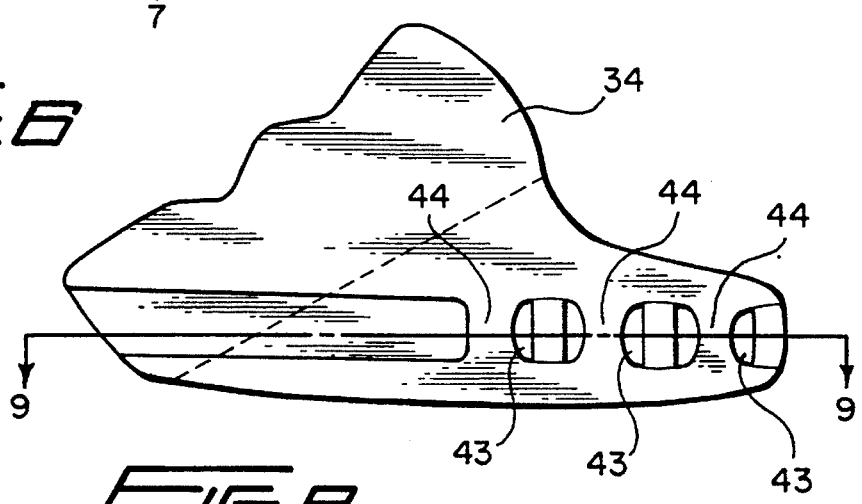
FIG. 8 is a front view of a heel area support part.
Figure 9:
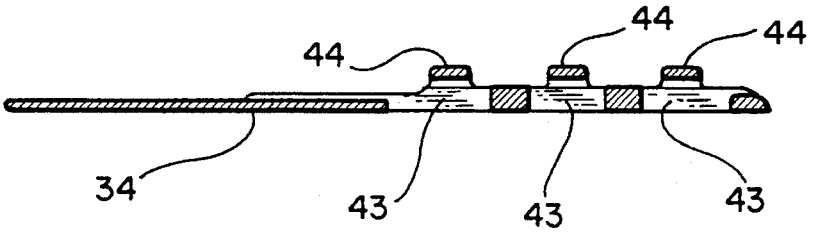
FIG. 9 is a cross-sectional view taken along line 9—9 of FIG. 8.
Figure 10:
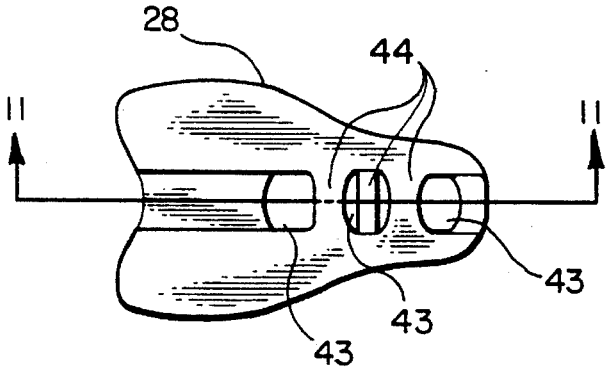
FIG. 10 is a front view of a frontal area support part.
Figure 11:
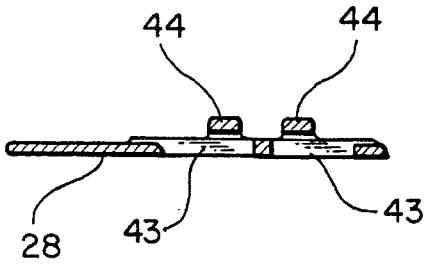
FIG. 11 is a cross-sectional view taken along line 11—11 of FIG. 10.

After the deflection over deflecting bar 14 of the next or rear coupling element 8, 8', pull strap 24 runs, in a slightly obliquely inclined direction, rearwardly downward to the heel area 33 of shoe 1 where an end section 32 is fastened. The end section 32 is passed through loops of a straplike support part 34 arranged outwardly on the heel counter and rests there flexibly or movably on upper 26 via this support part 34. Support part 34 is also inclined forwardly, as shown in FIG. 1 and by the dashed line approximation of the sole line in FIG. 8.

The orientation of the coupling elements 8, 8' is determined by their interaction with the loops 5 or 6 of the tightening element 4 and with the pull strap 24. These guiding and tightening parts, and the arrangement of the support parts 28, 34 and the holding strap 31 are preferably configured so that a tensile force 35 is produced on the deflecting element 7 of the front coupling element 8, 8' which is directed toward area 29 of the middle of the foot, and so that a resulting tensile force 36 on the deflecting element 7 of rear coupling element 8, 8' is produced which is directed toward heel area 33. As a result of this arrangement, the pull strap 24 is tightened in a zigzag or saw-tooth pattern.

It is important that the coupling elements 8 be freely movable on the medial and lateral sides of the upper and that they be positionally fixed on the upper 26 or on sliding surfaces 37 or 38 formed by lateral portions of the instep cover 2 only by the gripping power of the pull strap 24 and of the tightening element 4. In particular, the arrangement of the abovementioned tightening and guiding parts is selected so that individual pull strap sections 39 to 42 are each inclined forward and upward in a direction from the supporting straps 25, 31, 34 to the coupling elements 8, 8'. As a result, an especially good holding of the foot in the shoe 1 is achieved.

For good guiding of pull strap 24 in the area of its fastening on shoe 1, support parts 28 and 34 are provided with openings 43 and bars or loops 44, so that pull strap 24 can be passed therethrough, h so as to be securely guided.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Shoe with an upper made of resiliently flexible materials, a central rotary closure, an instep cover on an instep area of the upper, said central rotary closure being provided on said instep cover, at least one tightening element connected to the central rotary closure, and guide elements at side parts of the upper, each of said guide elements having a deflecting element and said at least one tightening element being guided from the instep cover laterally in the form of loops at each side of the upper, each loop being guided over the deflecting element of a respective one of the guide elements at a respective one of the side parts of the upper, said central rotary closure forming a means for shortening the tightening element by rotating the central rotary closure to close the shoe and as a means for increasing a free length of the tightening element to open the shoe; wherein the deflecting element of each guide element is provided as a deflecting bar on a freely movable coupling element; wherein, at each side of the shoe, a first end portion of a pull strap is fastened to the shoe in an area at which a metatarsophalangeal joint portion of a wearer's foot is received; wherein the pull strap is guided from said first end portion, over the deflecting bar of a front one of the coupling elements, to a deflecting element located in an area of the metatarsus at a lateral side of the shoe and to a deflecting element located in an arch area at a medial side of the shoe, and is guided from the respective deflecting element, over the deflecting bar of a more rearward coupling element, rearwardly to an area at which the heel of the wearer's foot is received and at which a second end portion of the pull strap is fastened; wherein each of the coupling elements is free to move relative to the shoe upper, being carried only by a respective one of said loops of the at least one tightening element and by the pull strap.

2. Shoe according to claim 1, wherein the guide elements are knob-shaped and the deflecting element thereof comprises a guiding groove for the at least one tightening element.

3. Shoe according to claim 2, wherein the guiding groove of each guide element is freely accessible at a rear side of the guide elements as a means for enabling the tightening element to be inserted into the guiding groove.

4. Shoe according to claim 3, wherein each coupling element comprises a pair of guide arms at an acute angle relative to each other, said guide arms being provided with openings therein through which the pull strap is passed.

5. Shoe according to claim 4, wherein the pull strap runs from each of the coupling elements, at both sides of the deflecting bar thereof, in an obliquely rearward and downward direction as a means for producing a tensile force on the guide element of front coupling element in a direction directed rearward and downward toward a central portion of the side part of the shoe and a tensile force on the guide element of the more rearward rear coupling element which is inclined obliquely toward the heel area of the shoe.

6. Shoe according to claim 1, wherein the pull strap runs in a zigzag or saw-tooth pattern.

7. Shoe according to claim 6, wherein the pull strap pattern is formed by pull strap sections which run in an upwardly and forward inclined direction toward each coupling element.

8. Shoe according to claim 7, wherein the end portions of the pull strap are fastened to the upper at support parts.

9. Shoe according to claim 8, wherein said support parts comprise means for guiding the end portions of the pull strap.

10. Shoe according to claim 9, wherein the means for guiding of the support parts comprise openings and bars which form loops through which the pull strap passes.

11. Shoe according to claim 1, wherein each coupling element comprises a pair of guide arms at an acute angle relative to each other, said guide arms being provided with openings therein through which the pull strap is passed.

12. Shoe according to claim 11, wherein the pull strap runs in a zigzag or saw-tooth pattern.

13. Shoe according to claim 11, wherein the pull strap runs from each of the coupling elements, at both sides of the deflecting bar thereof, in an obliquely rearward and downward direction as a means for producing a tensile force on the guide element of front coupling element in a direction directed rearward and downward toward a central portion of the side part of the shoe and a tensile force on the guide element of the more rearward rear coupling element which is inclined obliquely toward the heel area of the shoe

14. Shoe according to claim 12, wherein the pull strap runs in a zigzag or saw-tooth pattern.

* * * * *